US009820570B1

(12) United States Patent
Lee

(10) Patent No.: US 9,820,570 B1
(45) Date of Patent: Nov. 21, 2017

(54) COLLAPSIBLE SUPPORT APPARATUS WITH HINGED MULTI-TIER SHELVES AND SEPARABLE BUCKLE HINGES

(71) Applicant: Harry Kai Lee, Pomona, CA (US)

(72) Inventor: Harry Kai Lee, Pomona, CA (US)

( * ) Notice: Subject to any disclaimer, the term of this patent is extended or adjusted under 35 U.S.C. 154(b) by 0 days.

(21) Appl. No.: 15/417,863

(22) Filed: Jan. 27, 2017

(51) Int. Cl.

| | |
|---|---|
| ***A47B 43/00*** | (2006.01) |
| ***A47B 37/00*** | (2006.01) |
| ***A47B 81/06*** | (2006.01) |
| ***A47B 47/00*** | (2006.01) |
| ***A47B 3/08*** | (2006.01) |

(52) U.S. Cl.
CPC ..... *A47B 43/00* (2013.01); *A47B 3/08* (2013.01); *A47B 37/00* (2013.01); *A47B 47/00* (2013.01); *A47B 81/06* (2013.01); *A47B 2200/0035* (2013.01); *A47B 2200/04* (2013.01)

(58) Field of Classification Search
CPC ..... A47B 43/00; A47B 43/003; A47B 46/00; A47B 2200/0035; A47B 2200/04; A47B 3/002; A47B 3/08
See application file for complete search history.

(56) References Cited

U.S. PATENT DOCUMENTS 9,451,824 B1 * 9/2016 Lee ..... A47B 81/06
2010/0116764 A1 * 5/2010 Lin ..... A47B 43/00 211/149
2010/0126952 A1 * 5/2010 Huang ..... A47B 43/00 211/134
2011/0017692 A1 * 1/2011 Marietta ..... A47B 43/00 211/195
2013/0221818 A1 * 8/2013 Ceballos ..... A47B 43/00 312/258
2015/0366338 A1 * 12/2015 Conod ..... A47B 47/0083 108/48

* cited by examiner

*Primary Examiner* — Daniel J Rohrhoff
(74) *Attorney, Agent, or Firm* — Tommy SF Wang; Wang IP Law Group, P.C.

(57) ABSTRACT

A collapsible support apparatus with hinged multi-tier shelves and separable buckle hinges provides multiple tiers of shelves with a folding upper shelf that is designed to support a television, and that can be pulled out and secured with separable buckle hinges, so as to enable enhanced lateral stability of the television or any other object being supported. The apparatus further comprises a middle and lower shelf disposed arranged in a stacked arrangement beneath the upper shelf. The apparatus further comprises strategically positioned separable buckle hinges that pivot up to 90° and separate for facilitated collapsibility and assemblage. The apparatus further comprises elongated crossbars, support members, connecting bars, and a rectangular frame that hingedly interconnect about at least one separable buckle hinge and at least one simple hinge to easily pivot between an expanded position for supporting the television, and a collapsed position for stowage and portability.

20 Claims, 11 Drawing Sheets

COLLAPSIBLE SUPPORT APPARATUS WITH HINGED MULTI-TIER SHELVES AND SEPARABLE BUCKLE HINGES

FIELD OF THE INVENTION

The present invention relates generally to a collapsible support apparatus with hinged multi-tier shelves and separable buckle hinges. More so, the collapsible support apparatus provides multiple tiers of shelves, including a top shelf that pivotally articulates out to an expanded position for supporting a television, and pivotally articulates to a collapsed position for stowage; whereby the collapsible support apparatus provides crossbars, support members, and a frame that hingedly interconnect through separable buckle hinges and simple hinges to enable pivotal articulation between an expanded position and a collapsed position; whereby the separable buckle hinges are configured to pivot up to 90° and separate, so as to enable both pivotal articulation and detachable connections between the components of the apparatus; whereby a pair of connecting bars are disposed transversely across the apparatus for enhancing lateral stability of the shelves in the expanded position.

BACKGROUND OF THE INVENTION

It is known that a television is a telecommunication medium used for transmitting moving images and sound. The television can transmit images that are monochrome, in color, or in three dimensions. Generally, one type of television, such as a flat screen television, is lighter and thinner than traditional television sets and video displays that use cathode ray tubes. However, the flat screen television does not have a wide base to rest on, and thus, requires an external support for adjustable positioning and viewing.

Typically, connecting mechanisms, such as brackets, mounts, and tables exist for flat screen televisions. One such support is a Flat Display Mounting Interface (FDMI). The FDMI is a family of standards defined by the Video Electronics Standards Association for mounting flat panel monitors, TVs, and other displays to stands or wall mounts. It is generally implemented on most modern flat-panel monitors and televisions.

Additionally, inexpensive stands for the flat screen television are available. However, often these stands, which require user assembly, often are not well designed with the thought of television dimensions and weight in mind. For example, the stands are often constructed of lightweight, inexpensive materials that are not conducive to stability. Furthermore, venting of the component heat is often poor, and may result in obvious holes and vents which detract from the aesthetic appeal of these stands. Additionally management of the considerable number of cables is typically an afterthought.

Better quality stands have improved appearance but may still not be carefully designed for home entertainment systems. For example fixed shelves do not take into account component size which often requires varying shelf clearance. Furthermore these stands can take a considerable amount of time to assemble. Even assembly for store display of the stand can be an issue as employee labor rates are high and time is often of the essence during new store openings and busy selling seasons. Additionally, assembly of the stands may require many assembly steps and proper orientation of parts.

Often, television stands, and supportive furniture structures in general, are shipped in a fully-assembled condition from a manufacturer to a retailer and then carried off by an end user to a home or office. Consequently, the television stands is generally bulky, cumbersome and difficult to transport in a space-efficient manner. That is to say, a fully-assembled television stands consumes relatively large shipping space during transport to a retailer.

Similarly, the end user may need to have available a specially-sized vehicle should he wish to carry the television stand to the home or office. The inefficient shipment of the television stand between the manufacturer and end user often results in inconvenience as well as significantly higher transportation costs which are commonly passed through to the purchaser.

Other proposals have involved folding television stands. The problem with these devices is that they do not provide a stable configuration while supporting the weight of the television, nor are the hinges for folding the television stand sufficiently detachable and pivotal.

Thus, an unaddressed need exists in the industry to address the aforementioned deficiencies and inadequacies. Even though the above cited methods for flat screen television stands meets some of the needs of the market, a collapsible television support assembly with dual support shafts and separable buckle hinges is still desired.

SUMMARY OF THE INVENTION

The present invention is directed to a collapsible support apparatus with hinged multi-tier shelves and separable buckle hinges. The collapsible support apparatus provides multiple tiers of shelves, including a folding upper shelf that is designed to support a television, and that pivots outwardly to support a television, or pivots inwardly for stowage and portability. The apparatus further comprises a middle shelf and a lower shelf disposed in a stacked arrangement beneath the upper shelf. The apparatus further comprises strategically positioned separable buckle hinges that pivot up to 90° and separate, so as to enable both pivotal articulation and detachable connections between the components of the apparatus.

In some embodiments, the support apparatus may include a folding entertainment table that can be assembled and connectible with minimal tools or skill set. The collapsible support apparatus provides an upper shelf, a middle shelf, and a lower shelf for supporting objects. The upper shelf is disposed above the middle and lower shelves and configured to support a television.

The apparatus further comprises elongated crossbars, support members, connecting bars, and a rectangular frame that hingedly interconnect about at least one separable buckle hinge and at least one simple hinge to easily pivot and detach from each other, so as to achieve an expanded position for supporting the television, and a collapsed position for stowage and portability.

In some embodiments, the apparatus may include an upper crossbar defined by a pair of upper ends. The upper crossbar is configured to at least partially support the upper shelf. A pair of protruding members extend from the upper crossbar to help support the upper shelf. The apparatus further provides a middle crossbar defined by a pair of middle ends. The middle crossbar configured to at least partially support the middle shelf. The apparatus further provides a lower crossbar defined by a pair of lower ends. The lower crossbar configured to at least partially support the lower shelf. The crossbars are disposed in a generally horizontal, spaced-apart relationship.

In some embodiments, the apparatus may include a first vertical support member that fixedly attaches in a generally perpendicular disposition to a respective end of the upper crossbar, the middle crossbar, and the lower crossbar. The first vertical support member is disposed to slope between the upper crossbar and the lower crossbar, whereby the sloped disposition helps support the upper shelf. Across from the first vertical support member is a second vertical support member that fixedly attaches in a generally perpendicular disposition to a respective end of the upper crossbar, the middle crossbar, and the lower crossbar. The second vertical support member is disposed to slope between the upper crossbar and the lower crossbar, whereby the sloped disposition helps support the upper shelf.

In some embodiments, the apparatus may include at least one separable buckle hinge configured to enable hinged and detachable connections. Specifically, the separable buckle hinge is used to fasten, connect, and pivot multiple sections of the apparatus relative to each other. The separable buckle hinge segments into two sections to enable separation and pivoting by the apparatus.

The separable buckle hinge may include a lip and a latching member. In one exemplary embodiment, the lip is attached to the middle arm, and the latching member is fastened to the front shaft end. The latching member pivotally fastens and detaches from the lip in a secure but adjustable manner. The latching member comprises a mounting panel, a lever, and a catch. The lever of the latching member is configured to pivot on a fulcrum to pivotally move the catch and engage the lip. In this manner, the lip catches and holds the latching member for detachable fastening. In one embodiment, the separable buckle hinge pivots up to 90°.

In operation of the separable buckle hinge, the lever is configured to pivot on the fulcrum selectively, to and from the lip, such that the catch engages and disengages from the lip. Once the catch clasps onto the generally protruding lip, a force is applied to the lever away from the lip to forcibly clamp the respective sections of the apparatus together. The direction of the lever may then be reversed to disengage the catch from the lip, and thereby enable separation of the respective sections of the apparatus.

In another type of hinging mechanism, the apparatus further comprises at least one simple hinge that is configured to enable hinged connections between the frame and the connecting bars of the apparatus. However, unlike the separable buckle hinge, the simple hinge does not separate. The simple hinge comprises a first hinge side that pivotally joins a second hinge side. In one embodiment, the simple hinge pivots up to 90°.

In some embodiments, the apparatus may include a pair of first connecting bars disposed in a generally parallel, spaced apart relationship. The pair of first connecting bars are defined by a first front end and a first rear end. The first front end for the pair of first connecting bars is pivotally carried by the upper crossbar and the lower crossbar. The pair of first connecting bars are coupled to the upper crossbar and the lower crossbar about the at least one simple hinge.

Similarly, the apparatus comprises a pair of second connecting bars disposed in a generally parallel, spaced apart relationship. The second connecting bars are defined by a second front end and a second rear end. The second front end for the pair of second connecting bars is pivotally carried by the upper crossbar and the lower crossbar. The pair of second connecting bars are coupled to the upper crossbar and the lower crossbar about the at least one simple hinge.

In some embodiments, the apparatus may include a generally rectangular frame. The frame provides structural integrity to the apparatus and is defined by an upper frame member, a lower frame member, a first frame member, and a second frame member. The first frame member is pivotally carried by the pair of first connecting bars about the separable buckle hinge. In this manner, the frame may pivot up to 90°, and separate from the first connecting bars while moving to the collapsed position. The second frame member is pivotally carried by the pair of second connecting bars about the simple hinge. In this manner, the frame may pivot up to 90°, yet simple separation is not possible with the simple hinge.

In this manner, manipulation of the apparatus between a collapsed position and an expanded position involves pivoting the first connecting bars and the frame between extended and coplanar configurations against the crossbars. The separable buckle hinge also works to detach the first connecting bars from the first frame member of the frame. The shelves are also detached and attached as needed.

In one embodiment, the pair of first connecting bars are pivoted about the separable buckle hinge to extend at an angle between the first vertical support member and the first frame member while in an expanded position. Conversely, the pair of first connecting bars are pivoted coplanar to the upper crossbar, the middle crossbar, and the lower crossbar while in a collapsed position.

Similarly, the pair of second connecting bars are pivoted about the simple hinge to extend at an angle between the second vertical support member and the second frame member while in an expanded position. The pair of second connecting bars are pivoted coplanar to the upper crossbar, the middle crossbar, and the lower crossbar while in a collapsed position.

The connecting bars provide lateral stability to the apparatus. The capacity to provide lateral stability is especially significant since the apparatus supports generally heavy televisions and entertainment devices. The transverse crossing of the connecting bars fills a space in the central region of the apparatus, which restricts undesirable torqueing, bending, and warping of the frame and crossbars that make up the apparatus. Further, the pair of connecting bars are also configured to pivot towards the crossbars and thereby form a coplanar arrangement with the upper crossbar, the middle crossbar, and the lower crossbar in the collapsed position.

Additionally, the frame pivotally articulates to a coplanar, spaced-apart relationship with the upper crossbar, the middle crossbar, and the lower crossbar while in the expanded position. To achieve the collapsed position, the frame is pivoted between the pair of first connecting bars and the upper crossbar, the middle crossbar, and the lower crossbar.

In one exemplary configuration, the pair of first connecting bars pivotally articulate to extend at an angle between the upper crossbar and the first frame member while in an expanded position. Conversely, the pair of first connecting bars pivotally articulate coplanar to the upper crossbar, the middle crossbar, and the lower crossbar to achieve the collapsed position. This forms a substantially flat configuration that is efficacious for stowage and portability of the apparatus.

In another exemplary configuration, the pair of second connecting bars pivotally articulate to extend at an angle between the second crossbar and the second frame member while in an expanded position. Conversely, the pair of second connecting bars pivotally articulate coplanar to the upper crossbar, the middle crossbar, and the lower crossbar to form the collapsed position. This forms a substantially flat configuration that is efficacious for stowage and portability of the apparatus.

In another exemplary configuration, the frame is disposed in a coplanar, spaced-apart relationship with the upper crossbar, the middle crossbar, and the lower crossbar while in the expanded position. Conversely, the frame is disposed between the pair of first connecting bars and the upper crossbar, the middle crossbar, and the lower crossbar while in the collapsed position. This forms a substantially flat configuration that is efficacious for stowage and portability of the apparatus.

Thus, the apparatus is specially configured so that the connecting bars and frame ends are hingedly and detachably connected together so that they may be quickly assembled and also disassembled and returned to the collapsed position for further storage or shipment.

One objective of the present invention is to provide a foldable television supportive apparatus that utilizes separable buckle hinges to fold, separate, and interconnect different sections of the apparatus, such that configuration between a collapsed position and an expanded position is quickly and easily performed.

Another objective is to provide a first and second pair of connecting bars that extend transversely through the apparatus to enhance overall lateral stability.

Another objective is to provide a sloped first and second vertical support member that enhances support of the upper shelf.

Another objective is to provide a greater level of portability for a television stand for moving and storage than non-foldable television stands.

Yet another objective is to enable fast collapsing for stowage without requiring tools.

Yet another objective is to attach shelves to the apparatus for storage of television related items.

Yet another objective is to provide a cost effective television stand that is stable enough to support heavy televisions, yet also configurable to easily collapse for stowage.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
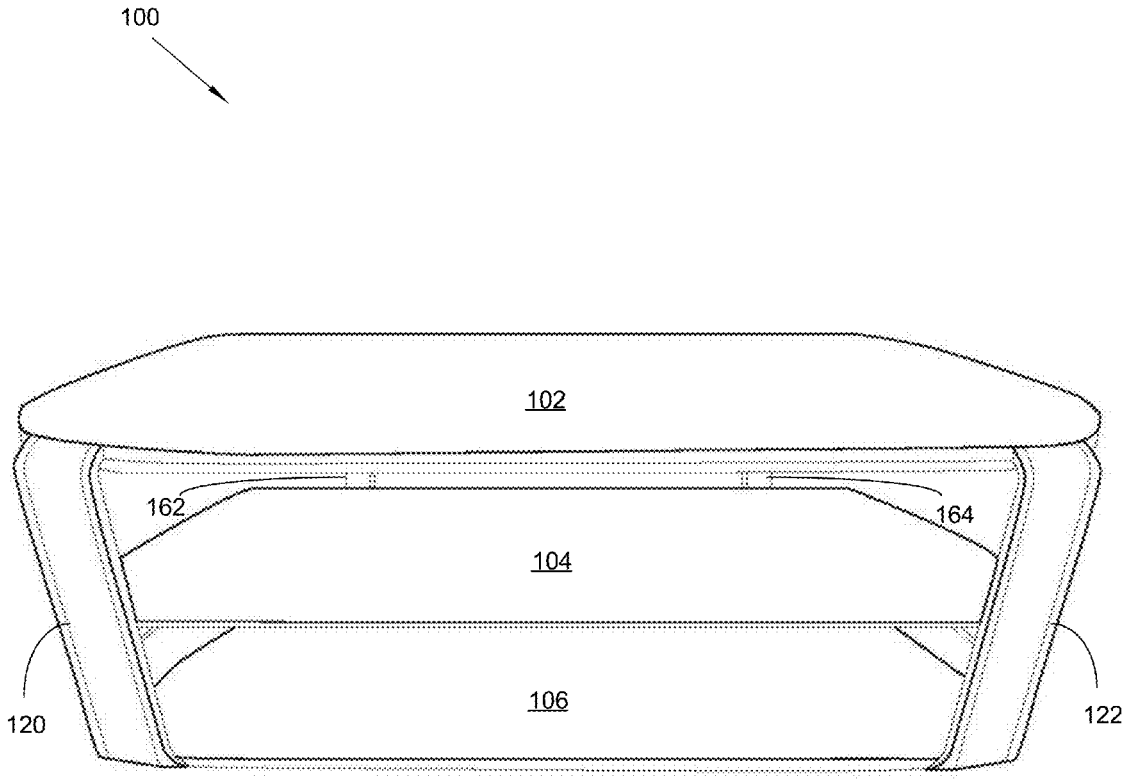
FIG. 1 illustrates a perspective view of an exemplary collapsible support apparatus with an attached upper shelf, middle shelf, and lower shelf, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-12, a collapsible support apparatus 100 with hinged multi-tier shelves and separable buckle hinges provides a television support structure having multiple tiers of shelves, including a folding upper shelf 102 that is designed to support a television and a middle and lower shelf that support other objects pertinent to the television or shelf related materials known in the art.

As referenced in FIG. 1, the collapsible support apparatus 100, hereafter "apparatus 100", is also configured to collapse and expand through pivotal articulation about at least one separable buckle hinge 124*a-f* and at least one simple hinge 138*a-h*. Various crossbars, support members, and sloped dispositions work to enhance lateral stability and structural integrity for support of a television or similarly weighted object.

Figure 2:
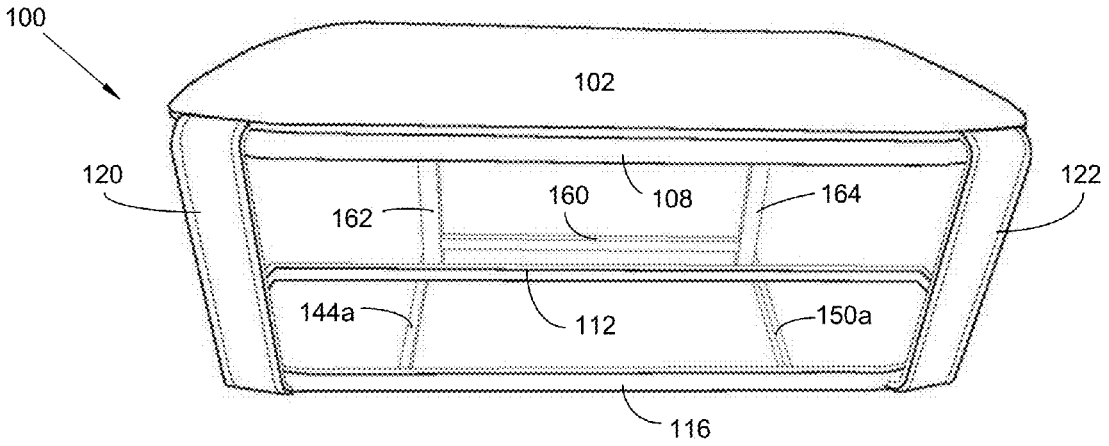
FIG. 2 illustrates a perspective view of the collapsible support apparatus shown in FIG. 1 with a middle shelf and a lower shelf detached, in accordance with an embodiment of the present invention.

Looking now at FIG. 2, the apparatus 100 provides a rigid, multi-configurable support structure for supporting a television or other entertainment device, such as a flat screen television, a stereo, a computer, or a video system. The apparatus 100 easily collapses for stowage, but also reversibly and easily expands for use without requiring tools or special skill. In some embodiments, the apparatus 100 is a folding television stand that can be assembled with minimal tools or skill set.

Figure 3:
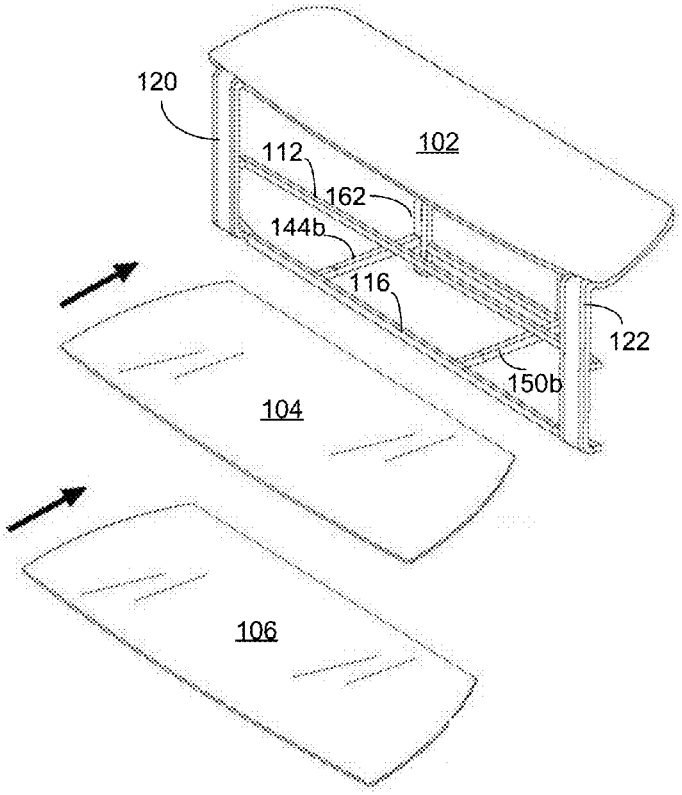
FIG. 3 illustrates a perspective view of the collapsible support apparatus shown in FIG. 1 with the middle shelf and the lower shelf detached sliding into position, in accordance with an embodiment of the present invention.

As referenced in FIG. 3, the apparatus 100 utilizes variously disposed and sized shelves and elongated supportive bars and members that interconnect about hinges to construct the laterally stable and pivotally detachable configurations described below. In one possible embodiment, the apparatus 100 may have a generally trapezoidal shape when viewed from above, and a wide base for supporting the weight of the television. Though in other embodiments, the apparatus 100 may also take other shapes when viewed from above, such as, a rhombus, a cube, a pyramid, an oval, or a rectangle. Suitable materials for the apparatus 100 may include, without limitation, wood, metal, fiberglass, rigid polymers, bamboo, and cardboard.

The apparatus 100 comprises an upper shelf 102 that supports the television, or similar object. The apparatus 100 further comprises a middle shelf 104 and lower shelf 106 disposed in a stacked arrangement beneath the upper shelf 102. The apparatus 100 further comprises strategically positioned separable buckle hinges 124*a-f* that pivot up to 90° and separate, so as to enable both pivotal articulation and detachable attachments between the components of the apparatus 100. This capacity to separate hinged connection points facilitates collapsibility and assemblage of the apparatus 100.

Further, at least one simple hinge 138*a-h* may also be used to enable pivotal articulation, solely for pivotal articulation. The apparatus 100 further comprises elongated crossbars, support members, connecting bars, and a rectangular frame that hingedly interconnect through the separable buckle hinge and the simple hinge 138*a-h* to easily move between an expanded position 174 for supporting the television, and a collapsed position 172 for stowage and portability.

Figure 4A:
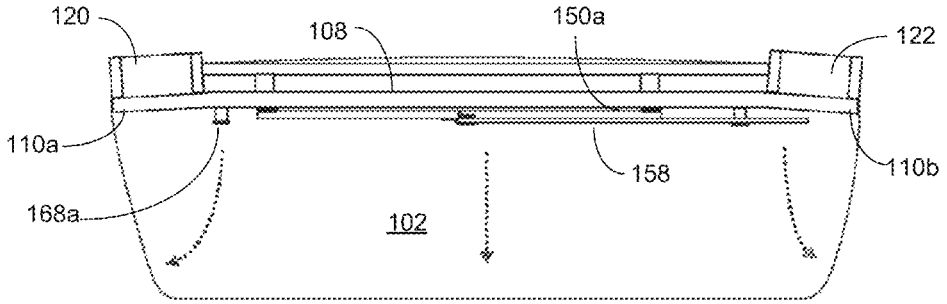
FIG. 4A illustrates a top view of the collapsible support apparatus in the collapsed position, in accordance with an embodiment of the present invention.

As referenced in FIG. 4A, the apparatus 100 comprises an upper shelf 102, a middle shelf 104, and a lower shelf 106 that are arranged in a stacked, spaced-apart relationship. The upper shelf 102 is arranged generally above the middle shelf 104 and the lower shelf 106. The upper shelf 102, the middle shelf 104, and the lower shelf 106 are generally flat and elongated, so as to support objects, such as a television. In one embodiment, the shelves are elongated and flat. The upper shelf 102 may be fabricated from glass. Though any of the shelves 102, 104, 106 may be fabricated from materials, including, without limitation, glass, wood, metal, plastic, granite, and fiberglass.

Figure 4B:
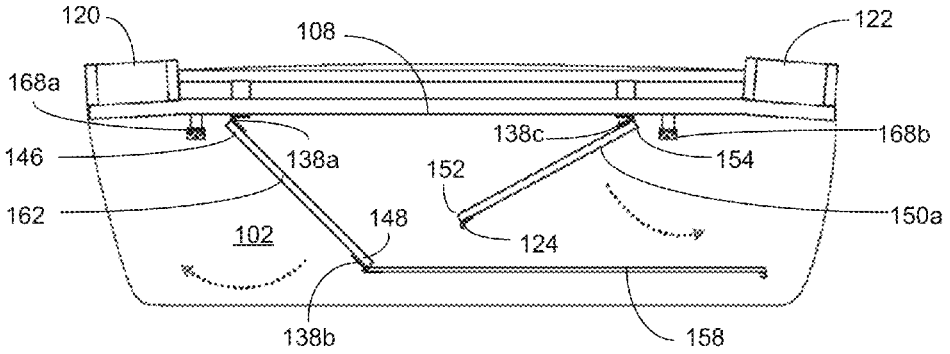
FIG. 4B illustrates a top view of the collapsible support apparatus shown in FIG. 4A pivotally articulating to the expanded position, in accordance with an embodiment of the present invention.
Figure 4C:
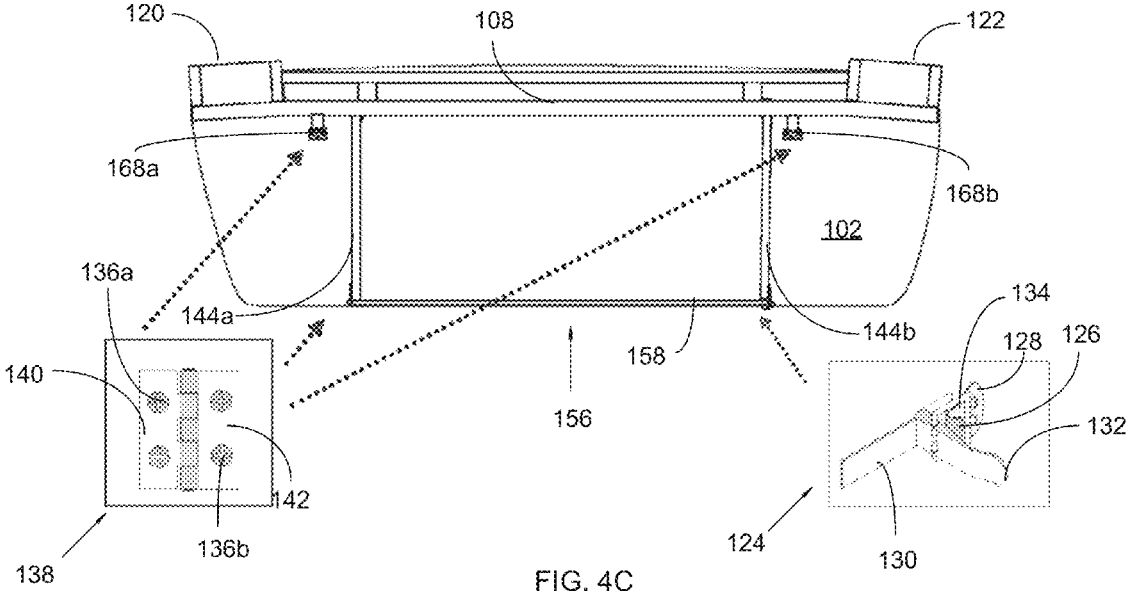
FIG. 4C illustrates a top view of the collapsible support apparatus shown in FIG. 4A in the expanded position, and with a blow up view of an exemplary separable buckle hinge and a simple hinge, in accordance with an embodiment of the present invention.

Looking now at FIGS. 4A and 4C, the apparatus 100 may include an upper crossbar 108 defined by a pair of upper ends 110*a*, 110*b*. The upper crossbar 108 is configured to at least partially support the upper shelf 102. In some embodiments, a pair of protruding members 168*a*, 168*b* extend from the upper crossbar 108 to help support the upper shelf 102. The apparatus 100 further provides a middle crossbar 112 defined by a pair of middle ends 114*a*, 114*b*. The middle crossbar 112 configured to at least partially support the middle shelf 104. The apparatus 100 further provides a lower crossbar 116 defined by a pair of lower ends 118*a*, 118*b*. The lower crossbar 116 is configured to at least partially support the lower shelf 106. The crossbars 108, 112, 116 are disposed in a generally horizontal, spaced-apart relationship.

Figure 5A:
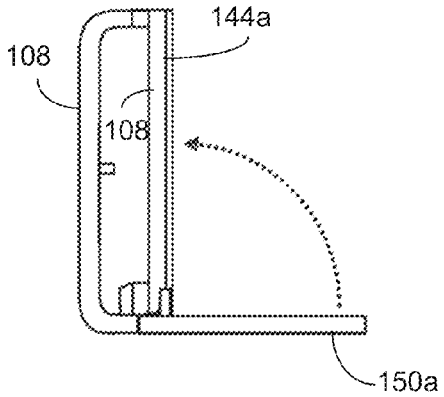
FIG. 5A illustrates a bottom view of the collapsible support apparatus in the collapsed position, in accordance with an embodiment of the present invention.
Figure 5B:
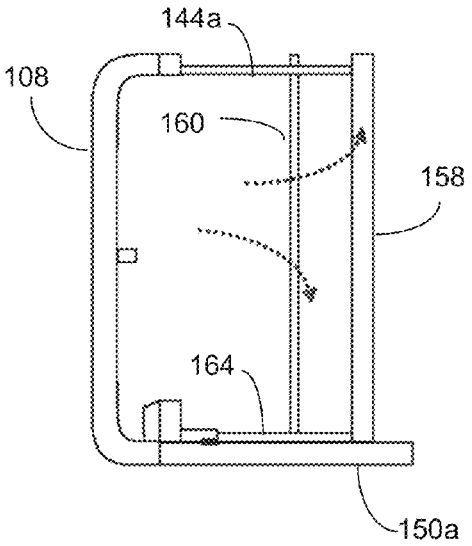
FIG. 5B illustrates a bottom view of the collapsible support apparatus shown in FIG. 5A pivotally articulating to the expanded position, in accordance with an embodiment of the present invention.
Figure 5C:
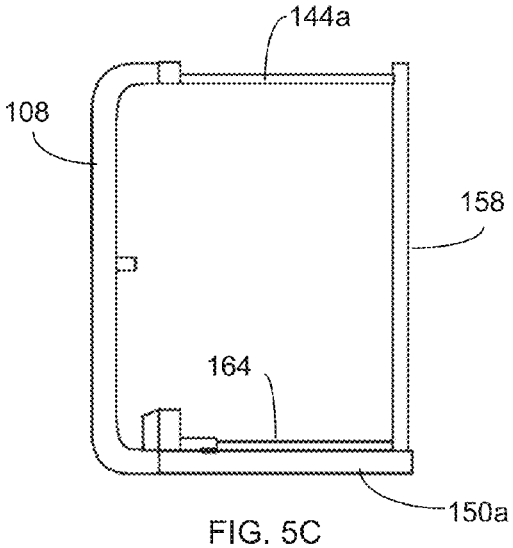
FIG. 5C illustrates a bottom view of the collapsible support apparatus shown in FIG. 5A in the expanded position, and with a blow up view of an exemplary separable buckle hinge and a simple hinge, in accordance with an embodiment of the present invention.

Looking now at FIGS. 5A, 5B, and 5C, the apparatus 100 includes a first vertical support member 120 that fixedly attaches in a generally perpendicular disposition to a respective end of the upper crossbar 108, the middle crossbar 112, and the lower crossbar 116. The first vertical support member 120 is disposed to slope between the upper crossbar 108 and the lower crossbar 116, whereby the sloped disposition helps support the upper shelf 102. The slope of the first vertical support member 120 extends at an outward angle towards the upper shelf 102. This sloped disposition reduces direct axial forces on the first vertical support member 120 from the weight of the television on the upper shelf 102.

Across from the first vertical support member 120 is a second vertical support member 122 that fixedly attaches in a generally perpendicular disposition to a respective end of the upper crossbar 108, the middle crossbar 112, and the lower crossbar 116. The second vertical support member 122 is disposed to slope between the upper crossbar 108 and the lower crossbar 116, whereby the sloped disposition helps support the upper shelf 102. The slope of the second vertical support member 122 extends at an outward angle towards the upper shelf 102. This sloped disposition reduces direct axial forces on the second vertical support member 122 from the weight of the television on the upper shelf 102.

Figure 8A:
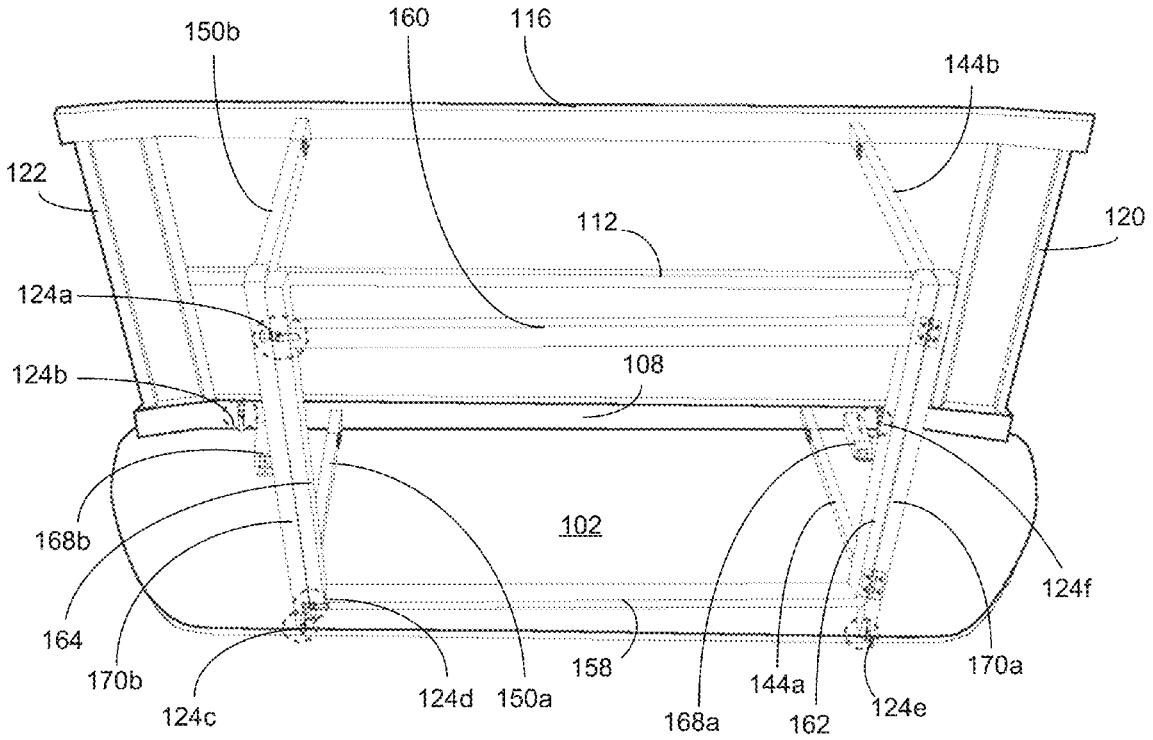
FIG. 8A illustrates a perspective view of the collapsible support apparatus in the expanded position, illustrating six separable buckle hinges.

Looking now at FIG. 8A, the apparatus 100 may include at least one separable buckle hinge 124*a-f* configured to enable hinged and detachable connections. Specifically, the separable buckle hinge 124*a-f* is used to fasten, connect, and pivot multiple sections of the apparatus 100 relative to each other. The separable buckle hinge 124*a-f* is configured to separate into two sections that enable both pivotal articulation and separation by the apparatus 100. In one embodiment, the at least one separable buckle hinge comprises six separable buckle hinges 124*a*, 124*b*, 124*c*, 124*d*, 124*e*, 124*f*.

Figure 8B:
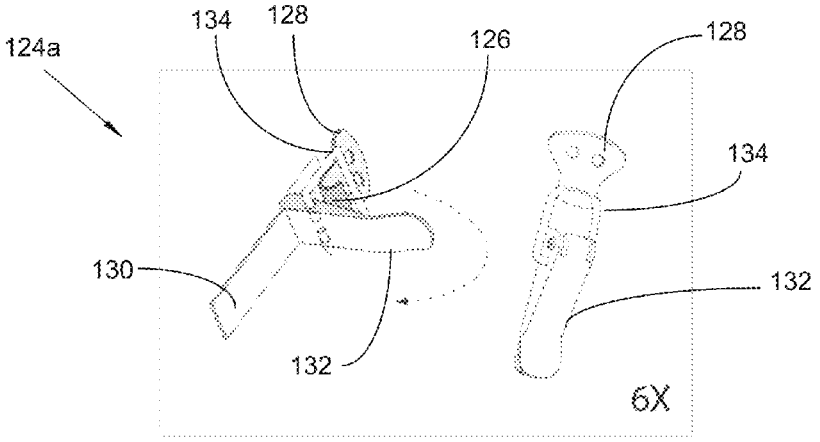
FIG. 8B illustrates a close up view of the separable buckle hinge, in accordance with an embodiment of the present invention.

As shown in FIG. 8B, the separable buckle hinge 124*a-f* may include a lip 126 and a latching member 128. In one exemplary embodiment, the lip 126 is attached to the middle crossbar 112, and the latching member 128 is fastened to the frame 156. The latching member 128 pivotally fastens and detaches from the lip 126 in a secure but adjustable manner. In one embodiment, the lip 126 enables passage of at least one screw 136*a*, 136*b* for fastening the lip 126 to the apparatus 100.

Furthermore, the latching member 128 comprises a mounting panel 130, a lever 132, and a catch 134. The lever 132 of the latching member 128 is configured to pivot on a fulcrum, so as to pivotally move the catch 134 and engage the lip 126. In this manner, the lip 126 retains and holds the latching member 128 for detachable fastening. In one embodiment, the separable buckle hinge 124*a-f* pivots up to 90°. In one embodiment, the mounting panel 130 of the latching member 128 enables passage of the at least one screw 136*a*, 136*b* for fastening the mounting panel 130 to the apparatus 100. In another embodiment, the latching member 128 pivots on a fulcrum. In yet another embodiment, the catch 134 is defined by a generally square shape.

In operation of the separable buckle hinge 124*a-f*, the lever 132 is configured to pivot on the fulcrum selectively, to and from the lip 126, such that the catch 134 engages and disengages from the lip 126. Once the catch 134 clasps onto the generally protruding lip 126, a force is applied to the lever 132 away from the lip to forcibly clamp the respective sections of the apparatus 100 together. The direction of the lever 132 may then be reversed to disengage the catch 134 from the lip 126, and thereby enable separation of the respective sections of the separable buckle hinge 124*a-f*.

Figure 7A:
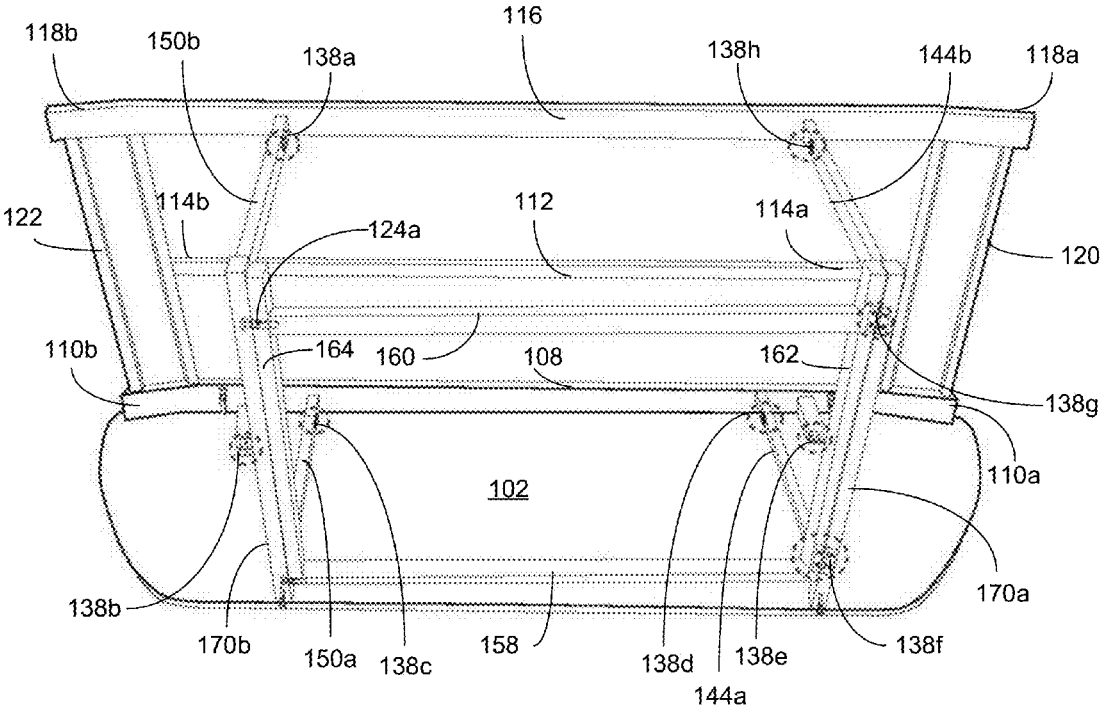
FIG. 7A illustrates a perspective view of the collapsible support apparatus in the expanded position, illustrating eight simple hinges.
Figure 7B:
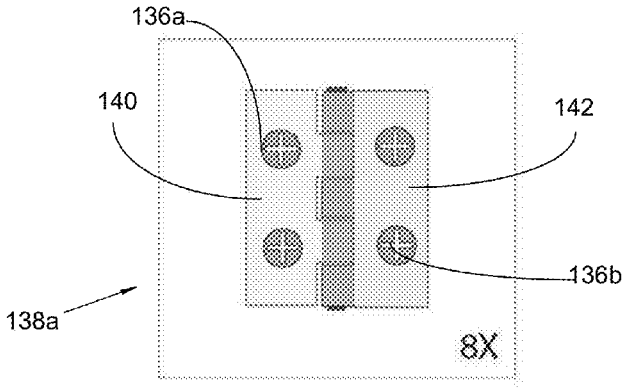
FIG. 7B illustrates a close up view of the simple hinge, in accordance with an embodiment of the present invention.

In another type of hinging mechanism shown in FIG. 7A, the apparatus 100 utilizes at least one simple hinge 138*a-h* that is configured to enable hinged connections between the frame 156 and the connecting bars 144*a-b*, 150*a-b* of the apparatus 100. However, unlike the separable buckle hinge 124*a-f*, the simple hinge 138*a-h* does not separate. The simple hinge 138*a-h* comprises a first hinge side 140 that pivotally joins a second hinge side 142, as illustrated in FIG. 7B. In one embodiment, the simple hinge 138*a-h* pivots up to 90°. In one embodiment, the at least one simple hinge 138*a-h* comprises eight simple hinges 138*a*, 138*b*, 138*c*, 138*d*, 138*e*, 138*f*, 138*g*, 138*h*.

In some embodiments, the apparatus 100 may include a pair of first connecting bars 144*a*, 144*b* disposed in a generally parallel, spaced apart relationship. The first connecting bars 144*a*, 144*b* are defined by a first front end 146 and a first rear end 148. The first front end 146 for the first connecting bars 144*a*, 144*b* is pivotally carried by the upper crossbar 108 and the lower crossbar 116. The first connecting bars 144*a*, 144*b* are coupled to the upper crossbar 108 and the lower crossbar 116 about the simple hinge 138*a-h*.

Figure 6A:
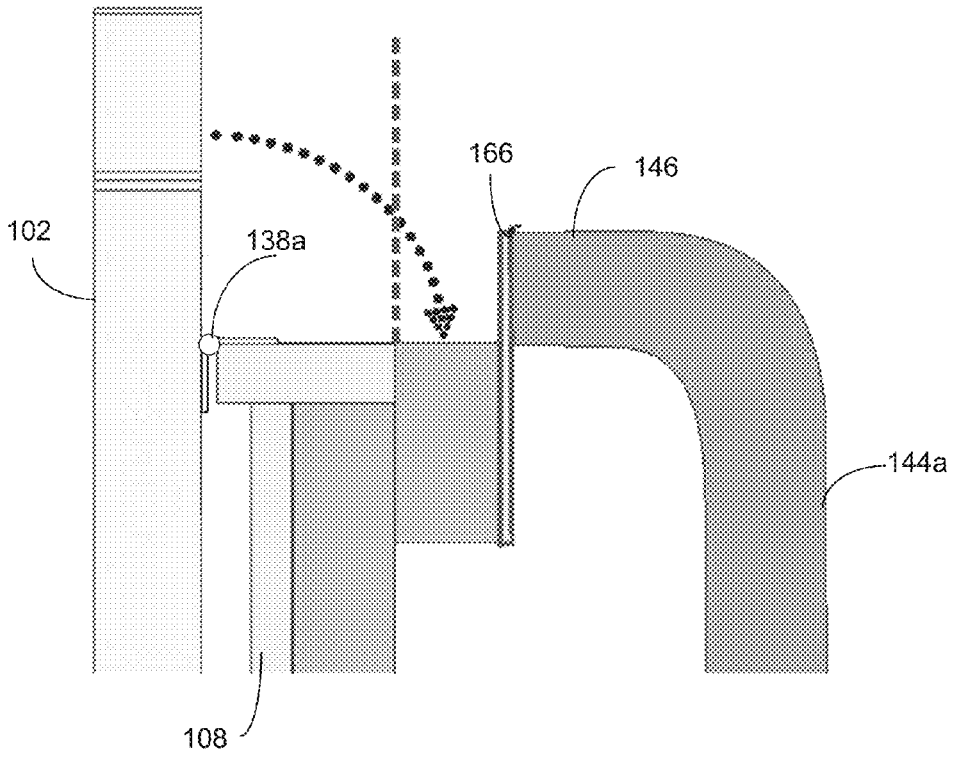
FIG. 6A illustrates a sectioned side view of the upper shelf hingedly pivoted to the collapsed position, in accordance with an embodiment of the present invention.
Figure 6B:
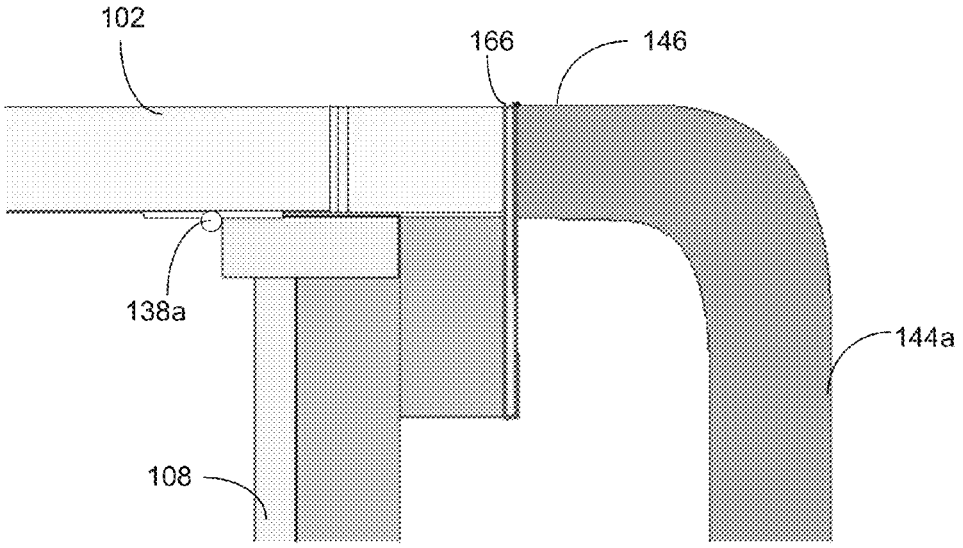
FIG. 6B illustrates a sectioned side view of the upper shelf hingedly extended to the expanded position, in accordance with an embodiment of the present invention.

As illustrated in FIGS. 6A and 6B, the hinging upper shelf 102 fixedly joins a welded metal panel 166 at the upper crossbar 108 and the first front end 146 of the first connecting member 144*a*, 144*b*. In another embodiment, a first reinforcement bar 170*a* extends between the first front end 146 of the pair of first connecting bars 144*a*, 144*b*. In the expanded position 174, the first reinforcement bar 170*a* runs parallel, and hingedly joined with the first frame member 162 of the frame 156. The first reinforcement bar 170*a* enhances the structural integrity of the apparatus 100, especially in the expanded position 174.

Similarly, the apparatus 100 comprises a pair of second connecting bars 150*a*, 150*b* disposed in a generally parallel, spaced apart relationship. The second connecting bars 150*a*, 150*b* are defined by a second front end 152 and a second rear end 154. The second front end 152 for the pair of second connecting bars 150*a*, 150*b* is pivotally carried by the upper crossbar 108 and the lower crossbar 116. The pair of second connecting bars 150*a*, 150*b* are coupled to the upper crossbar 108 and the lower crossbar 116 about the at least one simple hinge 138*a-h*.

In one embodiment, a welded metal panel 166 fixedly joins the upper crossbar 108 with the second front end 152 of the second connecting bar 150*a*, 150*b*. In another embodiment, a second reinforcement bar 170*b* extends between the second front end 152 of the pair of second connecting bars 150*a*, 150*b*. In the expanded position 174, the second reinforcement bar 170*b* runs parallel, and hingedly joined with the second frame member 164 of the frame 156. The second reinforcement bar 170*b* enhances the structural integrity of the apparatus 100, especially in the expanded position 174.

Looking ahead to FIG. 7A, the apparatus 100 may include a generally rectangular frame 156. The frame 156 provides structural integrity to the apparatus 100 and is defined by an upper frame member 158, a lower frame member 160, a first frame member 162, and a second frame member 164 that form the rectangular shape. The first frame member 162 is pivotally carried by the pair of first connecting bars 144*a*, 144*b* about the separable buckle hinge 124*a*. In this manner, the frame 156 may pivot up to 90°, and separate from the first connecting bars 144*a*, 144*b* while moving to the collapsed position 172. The second frame member 164 is pivotally carried by the pair of second connecting bars 150*a*, 150*b* about the simple hinge 138*a-h*. In this manner, the frame 156 may pivot up to 90°, yet simple separation is not possible with the simple hinge 138*a-h*.

In this manner, pivotal articulation of the apparatus 100 between a collapsed position 172 and an expanded position involves pivoting the first connecting bars 144*a*, 144*b* and the frame 156 between extended and coplanar configurations against the crossbars 108, 112, 116. The separable buckle hinge 124*a-f* also works to detach the first connecting bars 144*a*, 144*b* from the first frame member 162 of the frame 156. The shelves 102, 104, 106 are also detached and attached as needed.

As shown in FIG. 4B, the pair of first connecting bars 144*a*, 144*b* pivot about the separable buckle hinge 124*a-f* to extend at an angle between the first vertical support member 120 and the first frame member 162 while in an expanded position 174. Conversely, the pair of first connecting bars 144*a*, 144*b* are pivoted coplanar to the upper crossbar 108, the middle crossbar 112, and the lower crossbar 116 while in a collapsed position 172.

Similarly, the pair of second connecting bars 150*a*, 150*b* pivotally articulate about the simple hinge 138*a-h* to extend at an angle between the second vertical support member 122 and the second frame member 164 while in an expanded position 174. The pair of second connecting bars 150*a*, 150*b* are pivoted coplanar to the upper crossbar 108, the middle crossbar 112, and the lower crossbar 116 while in a collapsed position 172.

Looking back at FIG. FIG. 4C, the pair of first connecting bars 144*a*, 144*b* and the pair of second connecting bars 150*a*, 150*b* extend at an outward angle from the frame 156 to the upper crossbar 108 and the lower crossbar 116. This sloped disposition creates lateral stability for the apparatus 100, as torque and axial forces are dispersed along the slope. The capacity to provide lateral stability is especially significant since the apparatus 100 supports generally heavy televisions and entertainment devices. The transverse crossing of the connecting bars fills a space in the central region of the apparatus 100, which restricts undesirable torqueing, bending, and warping of the frame and crossbars that make up the apparatus 100.

Further, the pair of connecting bars 144*a-b*, 150*a-b* pivot towards the crossbars 108, 112, 116 and thereby form a coplanar arrangement with the upper crossbar 108, the middle crossbar 112, and the lower crossbar 116 in the collapsed position 172. In the collapsed position 172, structural integrity is not as primary a concern. However, the compactness of the coplanar configuration enhances stowage and portability of the apparatus 100.

Figure 9:
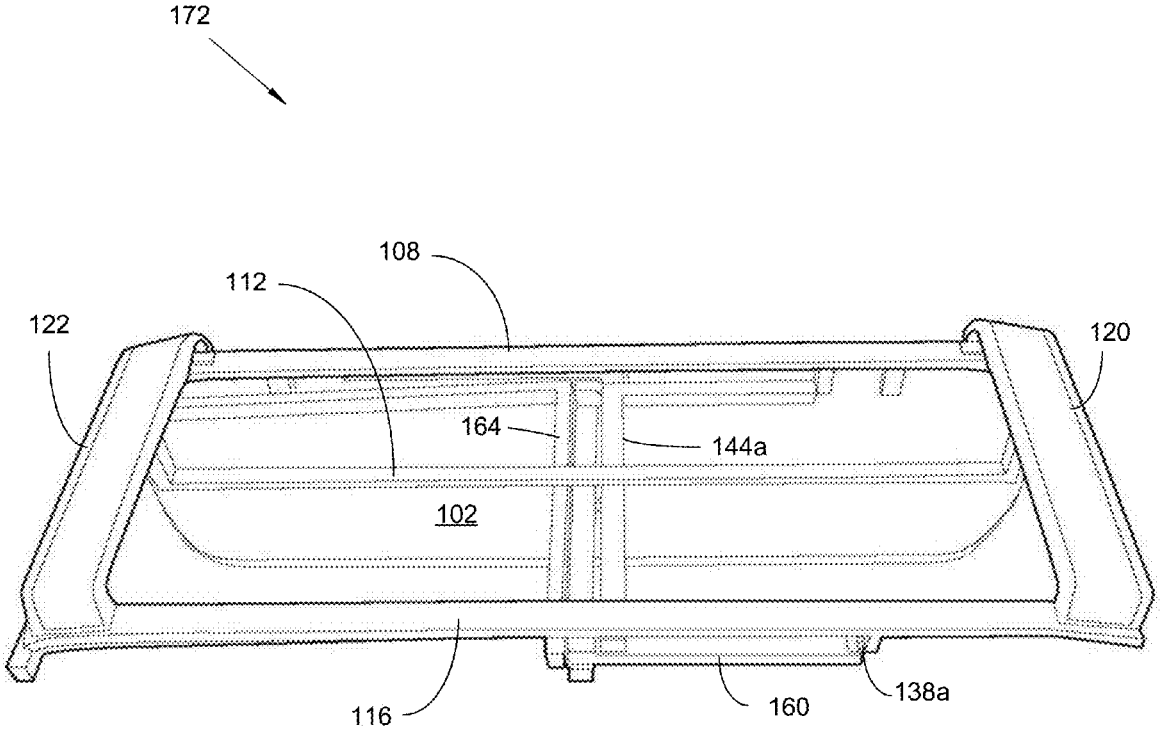
FIG. 9 illustrates a perspective view of the collapsible support apparatus in the collapsed position, in accordance with an embodiment of the present invention.

Additionally, the frame 156 is pivoted to a coplanar, spaced-apart relationship with the upper crossbar 108, the middle crossbar 112, and the lower crossbar 116 while in the expanded position 174. To achieve the collapsed position 172, the frame 156 is pivoted between the pair of first connecting bars 144*a*, 144*b* and the upper crossbar 108, the middle crossbar 112, and the lower crossbar 116. Further, the second frame member 164 detaches from the pair of second connecting bars 150*a*, 150*b* through the separable buckle hinge 124*a-f* while pivoting to the collapsed position 172 (FIG. 9).

Figure 10:
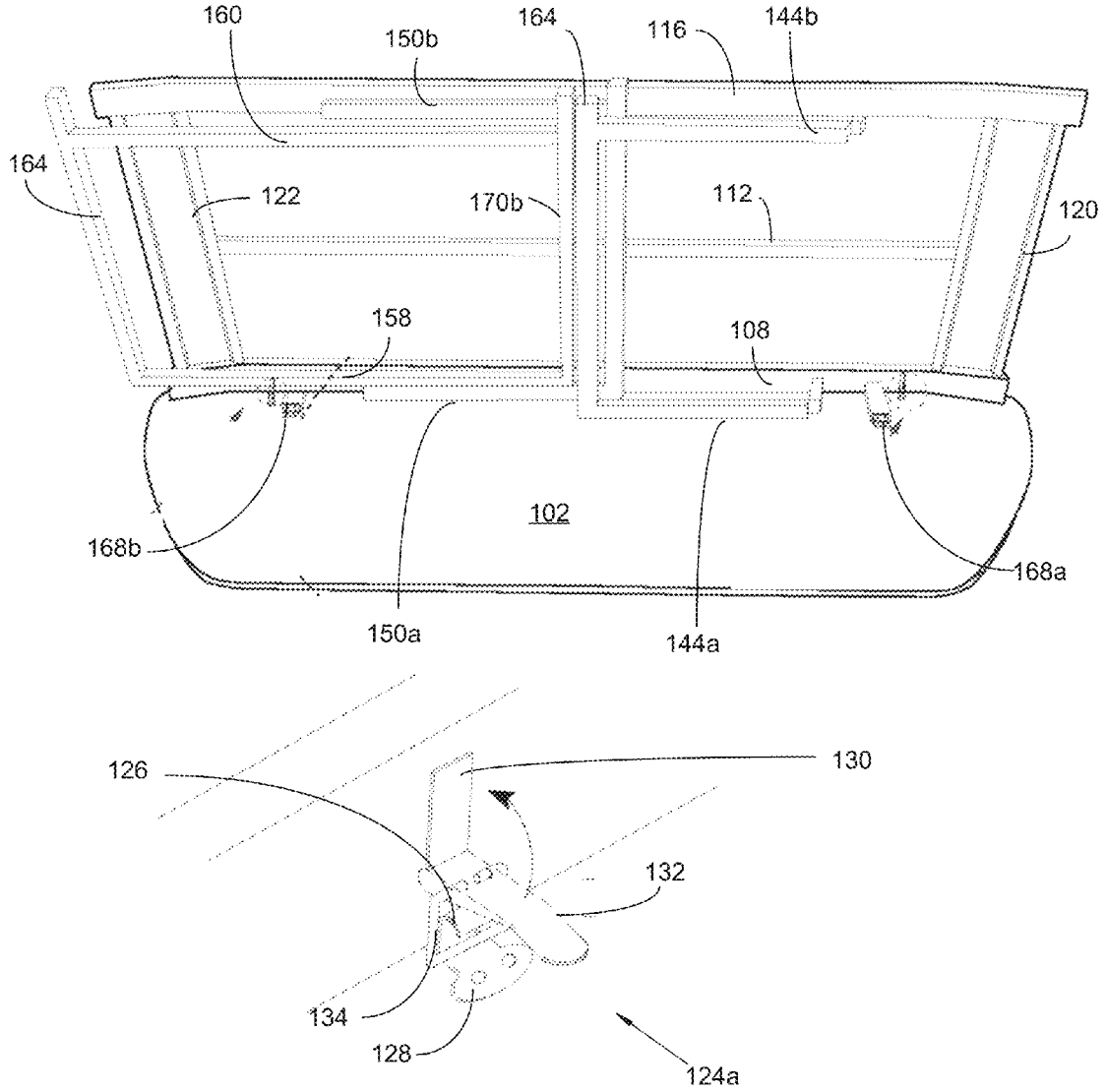
FIG. 10 illustrates a perspective view of the collapsible support apparatus in the collapsed position and with the upper shelf folded outwardly, in accordance with an embodiment of the present invention.

In one exemplary configuration shown in FIG. 10, the pair of first connecting bars 144*a*, 144*b* are disposed to extend at an angle between the upper crossbar 108 and the first frame member 162 while in an expanded position 174. Conversely, the pair of first connecting bars 144*a*, 144*b* move coplanar to the upper crossbar 108, the middle crossbar 112, and the lower crossbar 116 in the collapsed position 172. This forms a substantially flat configuration that is useful for stowage and portability of the apparatus 100.

Figure 11:
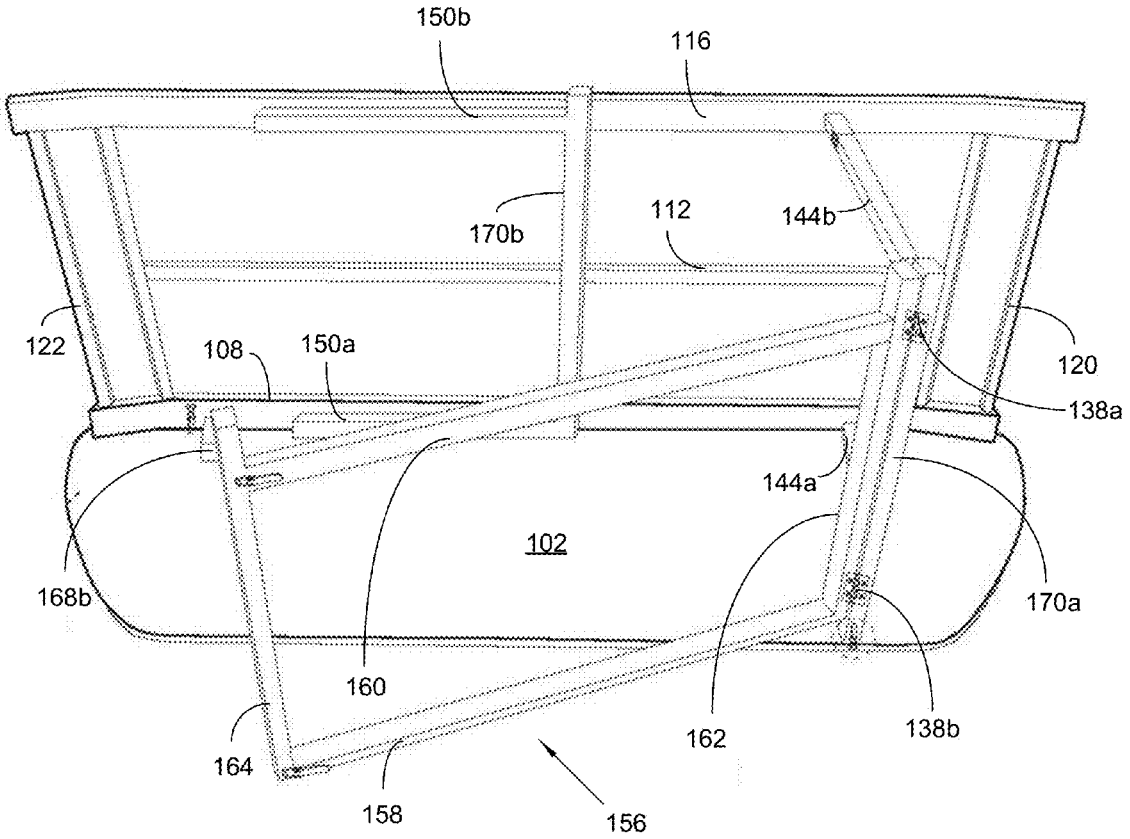
FIG. 11 illustrates a perspective view of the collapsible support apparatus pivotally articulating to the expanded position, in accordance with an embodiment of the present invention.

In another exemplary configuration shown in FIG. 11, the pair of second connecting bars 150*a*, 150*b* are disposed to extend at an angle between the middle crossbar 112 and the second frame member 164 while in an expanded position 174. Conversely, the pair of second connecting bars 150*a*, 150*b* move coplanar to the upper crossbar 108, the middle crossbar 112, and the lower crossbar 116 while in the collapsed position 172. This forms a substantially flat configuration that is efficacious for stowage and portability of the apparatus 100.

Figure 12:
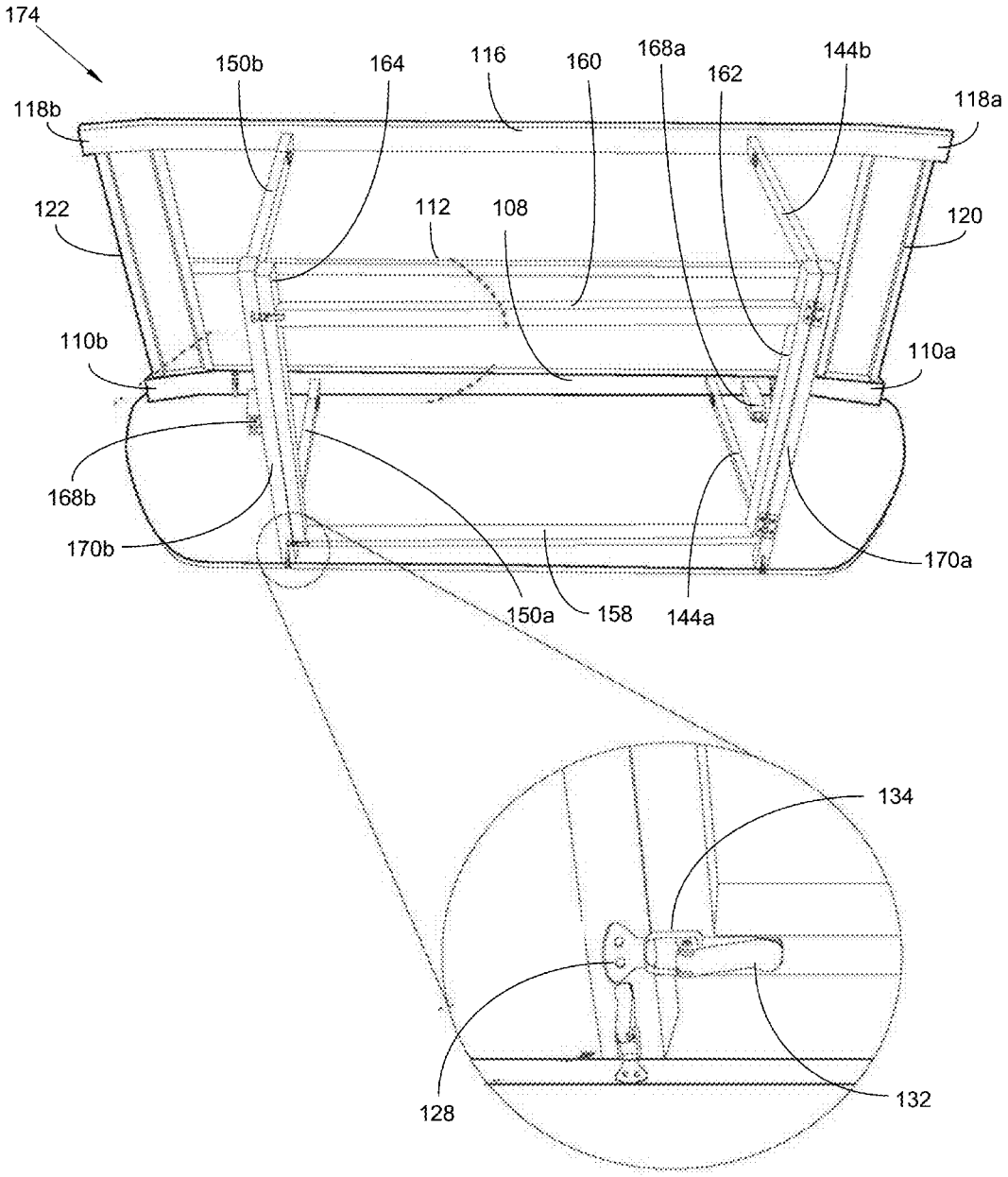
FIG. 12 illustrates a perspective view of the collapsible support apparatus in the expanded position, in accordance with an embodiment of the present invention.

In another exemplary configuration shown in FIG. 12, the frame 156 is disposed in a coplanar, spaced-apart relationship with the upper crossbar 108, the middle crossbar 112, and the lower crossbar 116 while in the expanded position 174. Conversely, the frame 156 is disposed between the pair of first connecting bars 144*a*, 144*b* and the upper crossbar 108, the middle crossbar 112, and the lower crossbar 116 while in the collapsed position 172. This forms a substantially flat configuration that is efficacious for stowage and portability of the apparatus 100.

Thus, the apparatus 100 is specially configured so that the connecting bars 108, 112, 116, 144*a-b*, 150*a-b* and frame ends 162, 164 are hingedly and detachably connected together so that they may be quickly assembled and also disassembled and returned to the collapsed position 172. The collapsed position 172 is useful for stowage and portability of the apparatus 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A collapsible support apparatus, the apparatus comprising:

an upper shelf;

a middle shelf;

a lower shelf, whereby the shelves are arranged in a stacked, spaced-apart relationship with the upper shelf arranged generally above the middle shelf and the lower shelf;

an upper crossbar defined by a pair of upper ends, the upper crossbar configured to at least partially support the upper shelf, whereby the upper shelf pivotally articulates in relation to the upper crossbar;

a middle crossbar defined by a pair of middle ends, the middle crossbar configured to at least partially support the middle shelf;

a lower crossbar defined by a pair of lower ends, the lower crossbar configured to at least partially support the lower shelf, whereby the crossbars are disposed in a generally horizontal, spaced-apart relationship;

a first vertical support member attached in a generally perpendicular disposition to a respective end of the upper crossbar, the middle crossbar, and the lower crossbar, the first vertical support member disposed to slope between the upper crossbar and the lower crossbar, whereby the sloped disposition helps support the upper shelf;

a second vertical support member attached in a generally perpendicular disposition to a respective end of the upper crossbar, the middle crossbar, and the lower crossbar, the second vertical support member disposed to slope between the upper crossbar and the lower crossbar, whereby the sloped disposition helps support the upper shelf;

at least one separable buckle hinge configured to enable hinged and detachable connections;

at least one simple hinge configured to enable hinged connections;

a pair of first connecting bars disposed in a generally parallel, spaced apart relationship, the pair of first connecting bars defined by a first front end and a first rear end, the first front end for the pair of first connecting bars pivotally carried by the upper crossbar and the lower crossbar, the pair of first connecting bars coupled to the upper crossbar and the lower crossbar about the at least one simple hinge;

a first reinforcement bar extending between the first front end of the pair of first connecting bars;

a pair of second connecting bars disposed in a generally parallel, spaced apart relationship, the pair of second connecting bars defined by a second front end and a second rear end, the second front end for the pair of second connecting bars pivotally carried by the upper crossbar and the lower crossbar, the pair of second connecting bars coupled to the upper crossbar and the lower crossbar about the at least one simple hinge;

a second reinforcement bar extending between the second front end of the pair of second connecting bars;

a generally rectangular frame defined by an upper frame member, a lower frame member, a first frame member, and a second frame member, the first frame member pivotally carried by the pair of first connecting bars, the first frame member coupled to the pair of first connecting bars about the at least one separable buckle hinge, the second frame member pivotally carried by the pair of second connecting bars, the second frame member coupled to the pair of second connecting bars about the at least one simple hinge;

whereby the pair of first connecting bars pivotally articulate to extend at an angle between the first vertical support member and the first frame member while pivoting to an expanded position;

whereby the pair of first connecting bars pivotally articulate coplanar to the upper crossbar, the middle crossbar, and the lower crossbar while pivoting to a collapsed position;

whereby the pair of second connecting bars pivotally articulate to extend at an angle between the second vertical support member and the second frame member while pivoting to the expanded position;

whereby the pair of second connecting bars pivotally articulate coplanar to the upper crossbar, the middle crossbar, and the lower crossbar while pivoting to the collapsed position;

whereby the second frame member detaches from the pair of second connecting bars through the at least one separable buckle hinge while pivoting to the collapsed position;

whereby the frame pivotally articulates to a coplanar, spaced-apart relationship with the upper crossbar, the middle crossbar, and the lower crossbar while pivoting to the expanded position; and whereby the frame pivotally articulates between the pair of first connecting bars and the upper crossbar, the middle crossbar, and the lower crossbar while pivoting to the collapsed position.

2. The apparatus of claim 1, wherein the apparatus is a television table.

3. The apparatus of claim 1, wherein the at least one separable buckle hinge enables pivoting up to ninety degrees.

4. The apparatus of claim 1, wherein the at least one separable buckle hinge comprises six separable buckle hinges.

5. The apparatus of claim 1, wherein the at least one simple hinge enables pivoting up to ninety degrees.

6. The apparatus of claim 1, wherein the at least one simple hinge comprises eight simple hinges.

7. The apparatus of claim 1, further comprising a pair of protruding members extending from the upper crossbar to help support the upper shelf.

8. The apparatus of claim 1, wherein the first vertical support member and the second vertical support member are vertically disposed.

9. The apparatus of claim 1, wherein the pair of first connecting bars and the pair of second connecting bars extend at an outward angle from the frame to the upper crossbar and the lower crossbar.

10. The apparatus of claim 1, wherein the first reinforcement bar runs parallel, and hingedly joined with the first frame member of the frame in the expanded position.

11. The apparatus of claim 1, wherein the second reinforcement bar runs parallel, and hingedly joined with the second frame member of the frame in the expanded position.

12. The apparatus of claim 1, wherein the slope of the first and second vertical support members extends at an outward angle towards the upper shelf.

13. The apparatus of claim 1, wherein the at least one separable buckle hinge is defined by a lip and a latching member, the latching member having a mounting panel, a lever, and a catch, the lever configured to pivotally engage the catch to the lip, whereby the lip and the latching member detachably fasten.

14. The apparatus of claim 13, wherein the lip of the at least one separable buckle hinge enables passage of at least one screw for fastening the lip to the apparatus.

15. The apparatus of claim 14, wherein the mounting panel of the latching member enables passage of the at least one screw for fastening the mounting panel to the apparatus.

16. The apparatus of claim 13, wherein the lever of the latching member pivots on a fulcrum.

17. The apparatus of claim 13, wherein the catch is generally square-shaped.

18. The apparatus of claim 1, wherein the at least one simple hinge is defined by a first hinge side configured to pivotally join with a second hinge side.

19. The apparatus of claim 1, further comprising a welded metal panel configured to fixedly join the upper crossbar with the first front end of the first connecting member, the welded metal panel further configured to fixedly join the upper crossbar with the second front end of the second connecting member.

20. A collapsible support apparatus, the apparatus consisting of:

an upper shelf;

a middle shelf;

a lower shelf, whereby the shelves are arranged in a stacked, spaced-apart relationship with the upper shelf arranged generally above the middle shelf and the lower shelf, whereby the upper shelf, the middle shelf, and the lower shelf are generally flat and elongated;

an upper crossbar defined by a pair of upper ends, the upper crossbar configured to at least partially support the upper shelf, whereby the upper shelf pivotally articulates in relation to the upper crossbar;

a pair of protruding members extending from the upper crossbar to help support the upper shelf;

a middle crossbar defined by a pair of middle ends, the middle crossbar configured to at least partially support the middle shelf;

a lower crossbar defined by a pair of lower ends, the lower crossbar configured to at least partially support the lower shelf, whereby the crossbars are disposed in a generally horizontal, spaced-apart relationship;

a first vertical support member fixedly attached in a generally perpendicular disposition to a respective end of the upper crossbar, the middle crossbar, and the lower crossbar, the first vertical support member disposed to slope between the upper crossbar and the lower crossbar, whereby the sloped disposition helps support the upper shelf;

a second vertical support member fixedly attached in a generally perpendicular disposition to a respective end of the upper crossbar, the middle crossbar, and the lower crossbar, the second vertical support member disposed to slope between the upper crossbar and the lower crossbar, whereby the sloped disposition helps support the upper shelf;

at least one separable buckle hinge configured to enable hinged and detachable connections, the at least one separable buckle hinge defined by a lip and a latching member, the lip of the at least one separable buckle hinge configured to enable passage of at least one screw for fastening the lip to the apparatus, the latching member having a mounting panel, a lever, and a catch, the lever configured to pivotally engage the catch to the lip, whereby the lip and the latching member detachably fasten;

at least one simple hinge configured to enable hinged connections, the at least one simple hinge defined by a first hinge side configured to pivotally join with a second hinge side;

a pair of first connecting bars disposed in a generally parallel, spaced apart relationship, the pair of first connecting bars defined by a first front end and a first rear end, the first front end for the pair of first connecting bars pivotally carried by the upper crossbar and the lower crossbar, the pair of first connecting bars coupled to the upper crossbar and the lower crossbar about the at least one simple hinge;

a first reinforcement bar extending between the first front end of the pair of first connecting bars;

a pair of second connecting bars disposed in a generally parallel, spaced apart relationship, the pair of second connecting bars defined by a second front end and a second rear end, the second front end for the pair of second connecting bars pivotally carried by the upper crossbar and the lower crossbar, the pair of second connecting bars coupled to the upper crossbar and the lower crossbar about the at least one simple hinge;

a second reinforcement bar extending between the second front end of the pair of second connecting bars;

a welded metal panel configured to fixedly join the upper crossbar with the first front end of the first connecting member, the welded metal panel further configured to fixedly join the upper crossbar with the second front end of the second connecting member;

a generally rectangular frame defined by an upper frame member, a lower frame member, a first frame member, and a second frame member, the first frame member pivotally carried by the pair of first connecting bars, the first frame member coupled to the pair of first connecting bars about the at least one separable buckle hinge, the second frame member pivotally carried by the pair of second connecting bars, the second frame member coupled to the pair of second connecting bars about the at least one simple hinge;

whereby the pair of first connecting bars pivotally articulate to extend at an angle between the first vertical support member and the first frame member while in an expanded position;

whereby the pair of first connecting bars pivotally articulate coplanar to the upper crossbar, the middle crossbar, and the lower crossbar while in a collapsed position;

whereby the pair of second connecting bars pivotally articulate to extend at an angle between the second vertical support member and the second frame member while pivoting to the expanded position;

whereby the pair of second connecting bars pivotally articulate coplanar to the upper crossbar, the middle crossbar, and the lower crossbar while pivoting to the collapsed position;

whereby the second frame member detaches from the pair of second connecting bars through the at least one separable buckle hinge while pivoting to the collapsed position;

whereby the frame pivotally articulates to a coplanar, spaced-apart relationship with the upper crossbar, the middle crossbar, and the lower crossbar while pivoting to the expanded position;

whereby the frame pivotally articulates between the pair of first connecting bars and the upper crossbar, the middle crossbar, and the lower crossbar while pivoting to the collapsed position; and whereby the upper shelf pivotally articulates about the at least one simple hinge while pivoting to the collapsed position.

* * * * *